United States Patent [19]

Broyles

[11] 3,952,658

[45] *Apr. 27, 1976

[54] ELECTRICALLY FIRED SUPERIMPOSED PROJECTILE

[76] Inventor: Howard F. Broyles, 4841 Maryland Ave., La Crescenta, Calif. 92014

[ * ] Notice: The portion of the term of this patent subsequent to Jan. 27, 1993, has been disclaimed.

[22] Filed: Dec. 7, 1973

[21] Appl. No.: 422,512

Related U.S. Application Data

[62] Division of Ser. No. 773,691, Sept. 26, 1968, Pat. No. 3,854,231.

[52] U.S. Cl. ..... 102/40

[51] Int. Cl.[2] ..... F42B 7/02

[58] Field of Search..... 102/21.6, 37.6, 37.7, 102/38, 40, 46

[56] References Cited

UNITED STATES PATENTS

| | | | |
|---|---|---|---|
| 712,826 | 11/1902 | Mason | 102/46 |
| 2,099,993 | 11/1937 | Tauschek | 42/1 R |
| 2,543,823 | 3/1951 | Barry | 102/20 |
| 2,832,265 | 4/1958 | Reid et al. | 89/1.814 |
| 3,451,306 | 6/1969 | Lagerstrom et al. | 102/40 |

FOREIGN PATENTS OR APPLICATIONS

| | | | |
|---|---|---|---|
| 581,316 | 8/1959 | Canada | 102/28 |

*Primary Examiner*—Stephen C. Bentley
*Attorney, Agent, or Firm*—John E. Wagner

[57] ABSTRACT

A superimposed charge projectile employing electrically actuated squibs with combinations of temperature and pressure fusing associated with each charge. Electrical conductors for the projectile are formed as a part of the longitudinal casing along the superimposed charges with both detonators and pressure switches located in the casing wall in communication with respective superimposed charges. The fuses are arranged so that the charges are armed and fired in sequence by the cooperative effort of pressure activated switches in the casing and thermally fusible armed links to enable each stage in sequence for firing through a common opening adjacent to the first or outermost superimposed charge.

8 Claims, 36 Drawing Figures

12
12
9
13
6
7
8
6
18
8

3
14
15
16
1

9
8
6
7

45
49
48
50

14
13
9
13
13
14

4
42
3
3
31
4
35

ELECTRICALLY FIRED SUPERIMPOSED PROJECTILE

REFERENCE TO RELATED APPLICATION

This is a division of application, Ser. No. 773,691 filed Sept. 26, 1968, now U.S. Pat. No. 3,854,231.

BACKGROUND OF THE INVENTION

This invention has been brought about by an obvious need to enhance the effectiveness of the individual soldier when he finds himself facing overwhelming odds in relation to manpower and close quarters fighting.

The unusual tactics involved in limited warfare, more often than not, finds United States forces in the situation described above. It is, therefore, most urgent that the fighting man have more effective weapons and an increased delivery means available.

The presently used automatic rifle and machine guns along with hand grenades and mortars and other such infantry weapons are effective only if they can be brought to bear on the enemy in a timely manner.

The weapons system described hereinafter makes it possible to bring to bear a variety of weapons in a matter of moments as the situation changes.

This weapon is also ruggedized and designed to withstand the most severe environment including being water-tight for submergence in the water for long periods.

A search of the literature of superimposed charges and Roman candle type firemarms reveals that, despite being a perennial favorite of weapons inventors who almost from the beginning of the firearms era in the early Fourteenth century recognized the awesome inherent firepower potential, they had virtually disappeared from military and sporting fields by the 1860's being replaced by the metallic self-contained cartridge type weapons.

The reasons were many. From the outset the multiple superimposed charge weapon was prone to premature ignition of unfired charges by gas leakage around the balls and from the compaction of unfired propellant by the rearward pressure developed during the firing of previous rounds.

SUMMARY OF THE DESCRIPTION

The following description is directed to a small arms weapon similar to a hi-low shotgun, having four barrels clustered together instead of two, but in substantially the same orientation.

The barrels are formed together as a cluster so that they may operate in the barrel receiver as would a single barrel. The cluster is disposed in an elongated groove formed in the barrel receiver-breech combination in a manner so as to allow the barrels to slide forward and move upward when unlocked from the breech to allow reloading of cartridges.

The appearance of the cartridges is similar to shotgun shells with the exception that they are much longer so as to provide a plurality of rounds to be disposed therein in a manner so as to be fired from the cartridge successively starting with the first round in the muzzle end of the cartridge.

The gun is electrically fired by a firing circuit disposed in the outer casings of the cartridge and individually connected to each round. The electrical power for firing the gun is provided by a rechargeable storage battery disposed in the grip of the trigger module.

A delayed firing squib circuit is also provided for use on ammunition such as grenades, etc., requiring time delay for range control operation.

Means for generating power to charge the battery is also included in the gun structure as well as means to charge the battery from an outside power source.

The cartridges are adaptable to a wide variety of types of ammunition, only four of which are described herein. Each round of ammunition consists of a propellant charge and a propelled charge. The novelty of these charges resides in the fact that the propelled charge is selected from a variety of missiles such as shot, fletchettes, etc., having voids which can be filled with the propelling charges, such as gun powder and the like, thus essentially cutting the over-all length and diameter of the rounds greatly.

These and other features of a hand gun weapon system are described in detail hereinafter supported by the drawings wherein:

DESCRIPTION OF THE DRAWINGS

FIG. 24 immediately below this circuit, shows typical redundant safety elements placed to each corresponding set of projectiles and recoil-cancelling charges to insure positive firing of said charges, consisting of an electric primer element at one charge and a thermopile element designated as TP inserted into the corresponding opposite charge.

FIG. 24, immediately below the safety circuit, shows the fusing circuits used to provide fusing electrical signals to the projectiles.

DETAILED DESCRIPTION OF THE INVENTION

Reference is directed to the figures. This small arms type gun consists of an elongated sheet metal barrel receiver 1 which is formed into a troughlike member for receiving a cluster of four barrels 2. The cluster of barrels 2 is formed by starting with a substantially thin walled sheet tubular member, best seen in FIG. 3, which provides the internal liner surface for the barrels and then winding the individual tubular members with a pre-impregnated glass filament layer 4. The barrels 2 are wound with the glass filament layer 4 to several times the thickness of the tubular member than placed in a curing oven. After having been properly cured the barrels are machined to a uniform outside diameter over about three-quarters of their length and diametrically reduced from this diameter to a substantially smaller diameter toward the muzzle end of the barrels. (See FIG. 13).

Figures 1, 2, 4, 5, 6, 7:
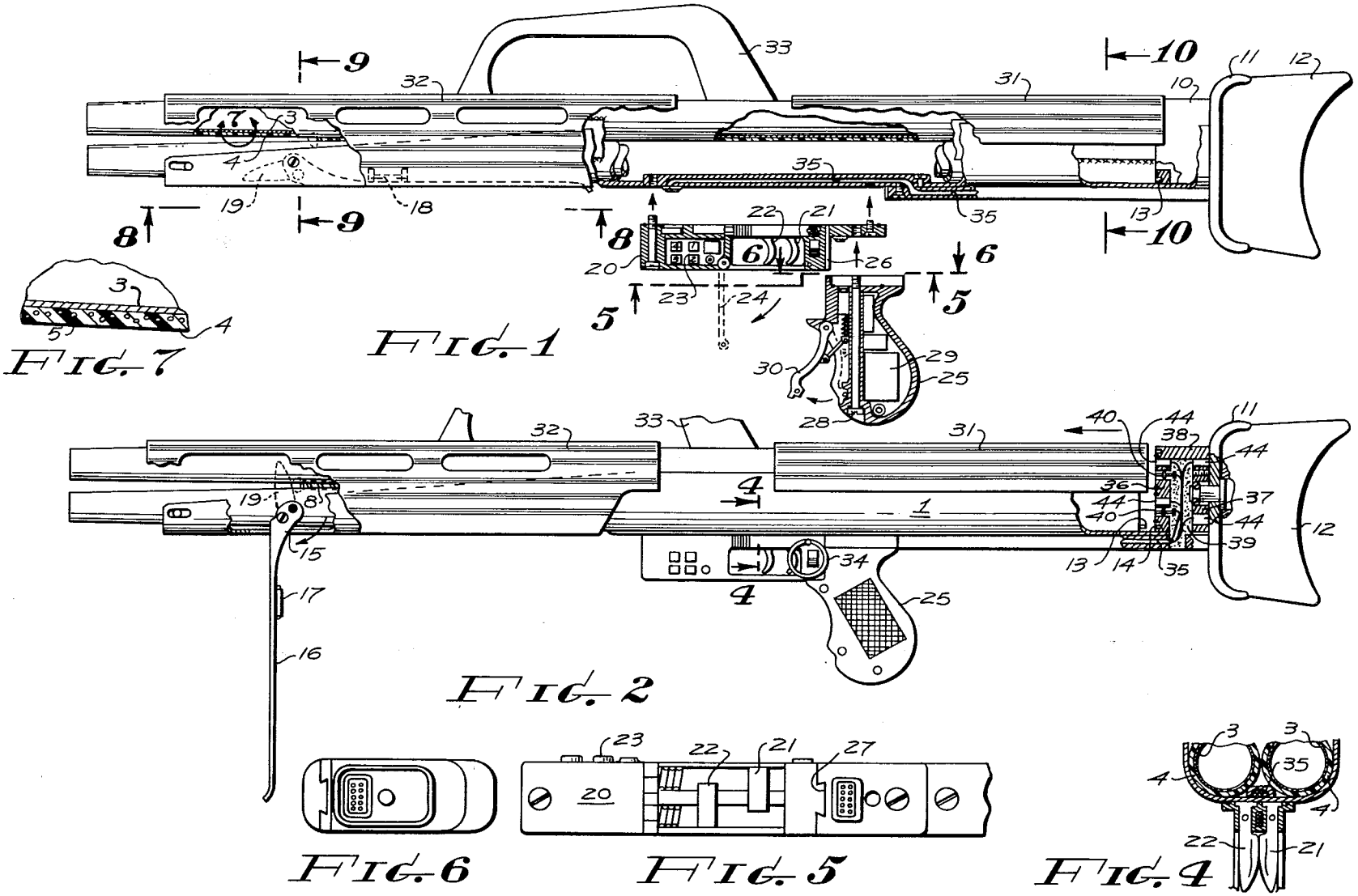
FIG. 1 is a partially fragmented exploded view of the gun showing the trigger module and the grip module as well as the coil wound barrels.
FIG. 2 is a partially fragmented elevation of the gun showing the mechanism for breaking the gun and a sectional view of the breech.
FIG. 4 is a section 4—4 of FIG. 2 showing the relationship of wiring passages and the sliding trigger blocks.
FIG. 5 is a section 5—5 of FIG. 1 showing the underside of the trigger module with the grip module removed and the trigger guard in the open position.
FIG. 6 is a section 6—6 of FIG. 1 showing the top of the grip module.
FIG. 7 is an enlarged section of FIG. 1 showing the coil winding on the muzzle end of the barrel.

Each barrel is provided with a coil winding 5 of FIG. 7 dispersed in the glass filament 4 near the muzzle end and located near the tubular liner 3. Referring again to FIG. 13, a plurality of spacers 6 are centrally disposed between the four barrels and in spaced relationship to one another in a maanner so as to allow the matching sides of the barrels to touch one another in order to allow the barrels to be cemented together at these four points.

The spacers 6 are provided with centrally disposed bores 7 which provide means for mounting a rod member 8 which, in turn, provides means for the actuating of an ejector 9.

The receiver 1 is provided with a breech block 10 to be described hereinafter. A butt plate 11 is rotatably mounted to the after end of the breech block 10 and provides means for mounting a recoil pad 12. A breech locking means consisting of a pin 13 and a socket 14 is provided as shown in FIG. 2, the pin 13 being disposed on the barrel cluster and the socket 14 being formed in the face of the breech block.

Figure 3:
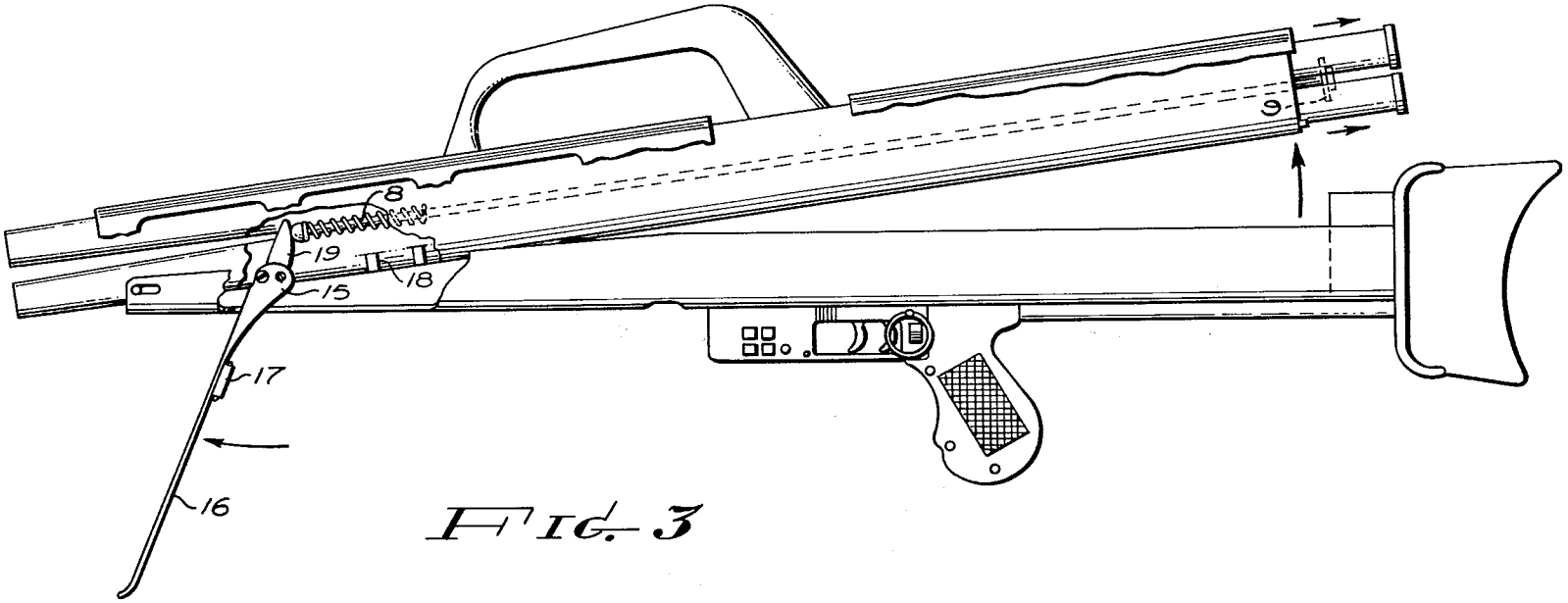
FIG. 3 is a partial elevation showing the gun broken for extracting the fired cartridges and to ready the gun for fresh cartridges. The fragmented area shows the ejector operation.
Figure 9:
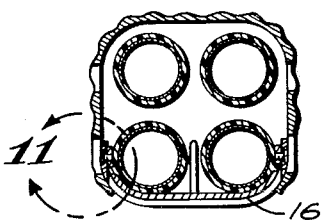
FIG. 9 is a sectional view 9—9 of FIG. 1 showing the break mechanism in the closed position.
Figure 8:
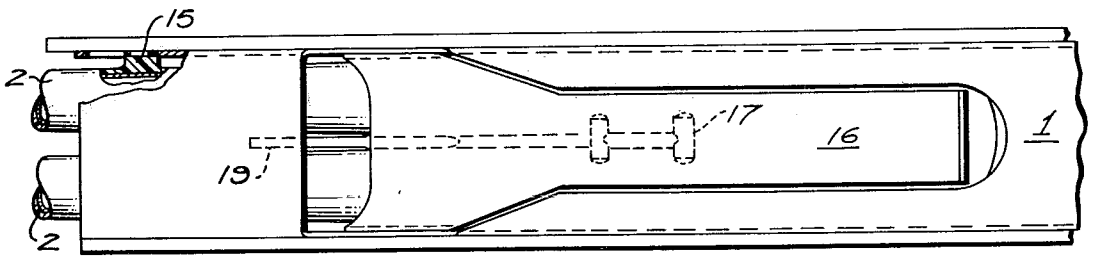
FIG. 8 is a view of the break mechanism in the closed position.

On the muzzle end of the receiver 1, an unlocking mechanism 15 is provided. This mechanism consists of a yoked lever 16. The yoke is disposed on one end of the lever and serves to interconnect the receiver 1 and the barrel cluster 2 being pivotally attached thereto in a manner so as to cause the barrels to move forward and away from the breech mechanism. (See FIG. 11). A lever locking member 17 is disposed on the upper side of the lever intermediate the ends thereof and adapted to cooperate with a latching member 18 mounted on the receiver 1. A short cam-like lever 19, as seen in FIG. 2, is adapted to engage the forward end of the ejector rod 8 and is formed on the unlock lever mechanism in a manner so as to lie between the two lower barrels and to move upward therebetween when the unlocking mechanism is actuated as is seen in FIGS. 3 and 9.

The receiver 1 is further provided with a substantially rectangular trigger module 20. This module 20 is removably mounted to the middle lower surface of the receiver 1.

The module 20 consists of a first trigger 21 for fire control. A second trigger 22 is mounted forward of the first trigger 21 and serves as a fuse-setting trigger to be used when firing fused ammunition. Forward of the triggers 21 and 22 is a pushbutton selector box 23 which provides means for selecting one of the four barrels to be fired.

A swing-away trigger guard 24 is swingably mounted to the after lower corner of the selector box 23 and adapted to fold up and lock over the triggers 21 and 22.

A grip module 25 consists of a hollow shell-like member formed in the shape of a pistol grip. A battery 29 is mounted in the lower portion of the internal cavity of the grip. A hand operated battery charger 30 is arranged in the front of the grip.

Other electrical and electronic components are arranged within the trigger module and the grip module. These components will be described hereinafter.

The barrel cluster 2 is covered by an elongated hood-like cheek piece 31 and a fore-end hood-like heat shield 32. A removable carrying handle 33 is mounted on top of the gun at the balance point for convenience in carrying.

A safety pin 34, shown in FIG. 2, having a pull ring provides a positive safety lock for the trigger mechanism.

A wire passageway 35 formed on the upper side of the receiver 1 above the trigger module, see FIG. 4, and running between the lower barrels back to the breech, provides means for electrically connecting the power generators and firing circuits to the battery 29 of FIG. 1.

The breech block 10 as shown in FIG. 2 is mounted on the after end of the receiver 1. The block is made up of a forward plate 36 and an after plate 37 which are rigidly mounted to an outside wall 38 covering three sides of the plates 36 and 37, thus forming a recess 39 within these walls accessible from the bottom side which is mounted to the receiver 1. The recess 39 is mounted in such a manner so that the passageway 35 opens into this recess.

The forward plate 36 is provides with four electrical firing connections 40 which are located in the face of the plate so as to be centrally located in each barrel when the barrels are locked into firing position against the plate.

The connections 40 make electrical contact with the cartridge firing circuit through a centrally located connector 41 in the face of the cartridge 42. See FIG. 16. Located near each of the firing connections 40 and in contact with the cartridge rims, are connections for contacting the fusing circuits 43 located in the periphery of the cartridge rim.

A third member located adjacent the firing and fusing connections is a piezoelectric crystal 44. Each of the four crystals are located in a manner so as to receive the recoil forces from the individual cartridge as it is fired thus generating current which feeds back to the battery 29.

Each of these units or groups of units in contact with the cartridge are surrounded by an O-ring seal which is disposed in the face of the breech in a manner so as to seal the breech end of each of the four barrels.

The after plate 37 is provided with a plurality of the piezoelectric crystal generators 44 which are placed in the after face of the plate in a manner so that the recoil force against the butt plate 11 will generate current to be fed back to the battery 29 for recharging.

The recess 39 provides means for electrical wiring circuits to be connected to the above described components. The recess is filled with a potting compound to fill the voids and lend strength to the block.

Referring now to FIGS. 16–22, the cartridge 42 is provided with a plurality of rounds instead of the conventional one round. The cartridges can be loaded with a great variety of ammunitions. Four of the more conventional rounds are shown and described hereinafter. The firing circuits for these rounds are generally the same and are representative of the recommended rounds for this weapons system.

The cartridge 42 consists of an inside metal shell 45 having a conventional closed end 46 and rim 47. A first insulation sleeve-like member 48 is disposed on the shell 45. A plurality of groups of through bores 49 is formed in the shell and insulating member. Each of these groups of through bores provides means for counting an electrical circuit in each of the round of ammunition disposed within the cartridge.

Figures 16, 17, 18, 19, 20, 21, 22, 35:
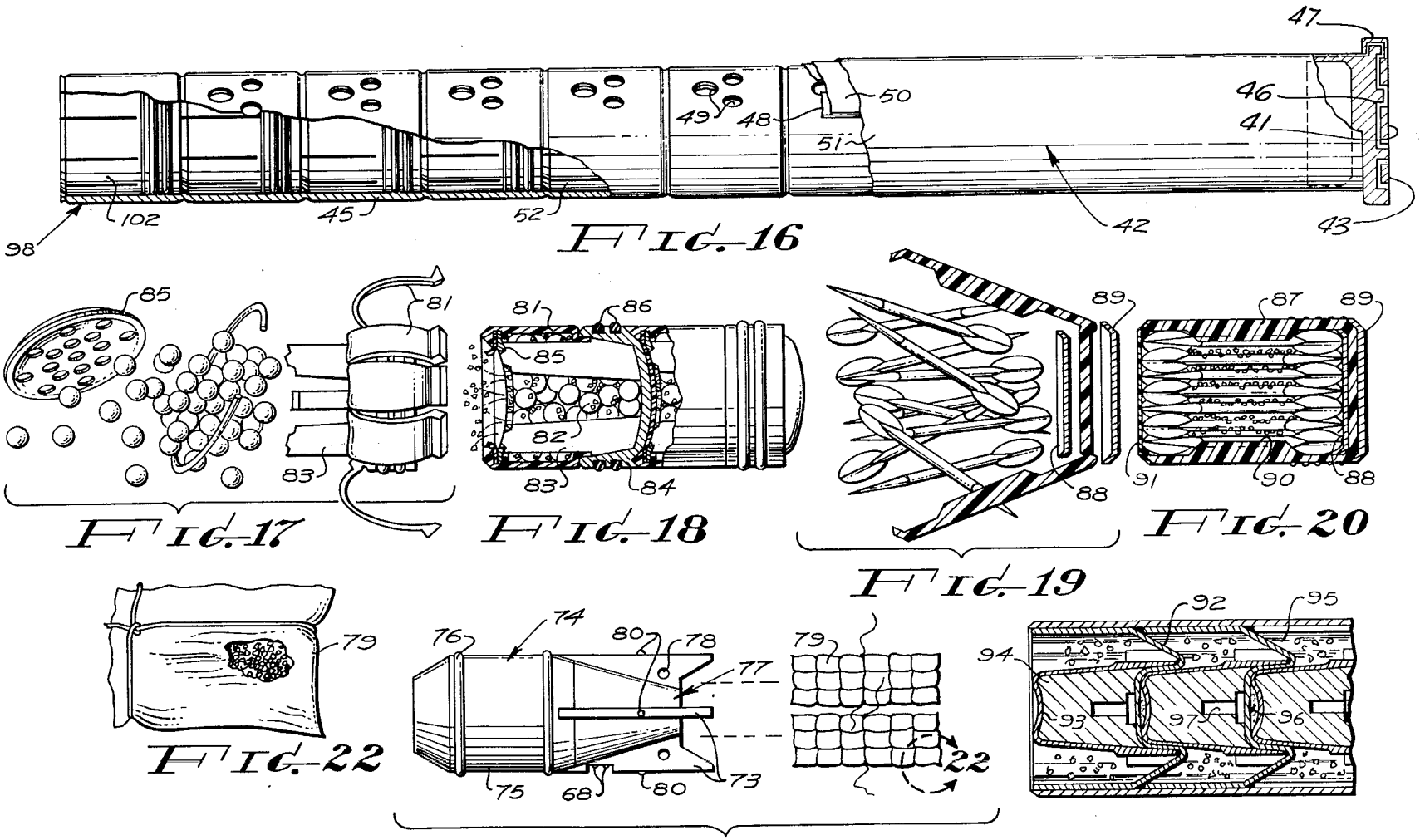
FIG. 16 is a fragmented view of a cartridge showing the firing and fusing circuits and how they are connected to the rounds as well as the general construction features of the cartridge.
FIG. 17 shows a propelled charge of buckshot as it clears the muzzle showing the retainer plate and opening spring bursting open the propelled charge unit to free the projectile, and the plastic envelope folding back and exposing the structural members used to support recoil pressure of previous charges.
FIG. 18 is a fragmented view of two buckshot rounds as they are placed in the cartridge. The fully sectioned charge is shown during firing with the propellant gases flowing out through the retainer plate to propel the driven charge yet retaining the projectile in place, and the second charge represents an unfired charge with its loading of projectiles, propellant charge and frangible seal cover intact.
FIG. 19 is a view of a fletchette charge as it clears the muzzle.
FIG. 20 is a sectional view of a fully loaded fletchette charge illustrating propellant and projectile placement and seal cover, and the method of retainment of fletchettes.
FIG. 21 is an elevational view of a grenade round with powder bags showing placement of boresafe pins and electrical fusing contacts on pin section.
FIG. 22 is an expanded view of the consumable propellant bags of FIG. 21.
FIG. 35 is a longitudinal sectional view of a special ammunition for loading in this type of cartridge.

The round of ammunition such as is shown in FIG. 18 are disposed in the cartridge and a drill is used to puncture the outer surface 52 of the round so that access to the powder is provided for the firing squib and other elements.

An electrical circuit 50, such as a printed circuit, is laid in place over the through bores 49. A second insulation sleeve 51 or outer sleeve, is disposed over the cartridge covering the electric circuitry and serving as the outer surface of the cartridge.

The circuitry designed for this system calls for some unusual elements which have been designed for this purpose. These are illustrated in FIGS. 26–34.

Figure 27:
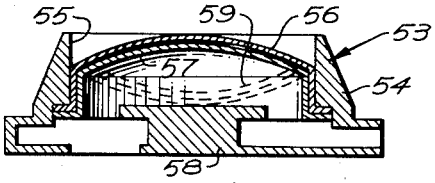
FIG. 27 is a sectional view of a snap-action pressure switch with positive latching action showing a drive type belleville element and a driven belleville contact element.

A snap action pressure switch 53, shown in FIG. 27, consists of a round body member 54 adapted to fit into one of the through bores 49. An annular recess 55 is centrally disposed in the body 54. A belleville spring type washer 56 designed to be snapped inside out, is hermetically sealed in the recess 55. A second spring member 57 substantially the same shape, but not a complete washer as is the first one, is snugly fitted against the washer 56. The elements just described are electrically isolated from an electrical contact 58 which is disposed in a manner to be contacted by the belleville washer 56 and the spring member 57 when pressure from the exploding charge in which it is disposed occurs. The alternate position is shown in dotted lines 59, thus closing the circuit.

The second spring member 57 is in the design because normally, following a concussion such as exploding powder, there is always a negative pressure which can cause the hermetically sealed washer to return to its original position. Even if this happens the spring 57 will stay in contact with contact 58 because it will not be affected by this negative pressure.

Figure 28:
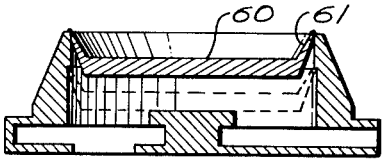
FIG. 28 is a sectional veiw of an alternate pressure switch to that shown in FIG. 27.
Figure 31:
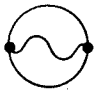
FIG. 31 is a symbol for FIG. 32.

A second species of this pressure switch is shown in FIG. 28 having the same body member and electrical contact arrangement but the belleville washer is replaced with a flat spring washer 60 having an upturned periphery 61 resembling a chevron seal. An internally disposed annular shoulder is formed in the recess 55 so that the outer periphery of the member 61 will be engaged, thus holding the contact against negative pressures.

Figure 30:
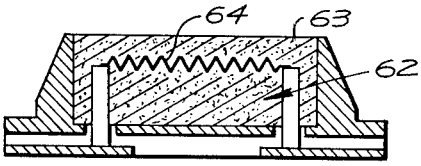
FIG. 30 is a sectional view of an electric squib.

The squib 62 shown in FIG. 30 is more or less standard. It is made up of an annular body member substantially the same as the pressure switch but the cavity is filled with an explosive 63 which is set off by the bridgewire arrangement 64.

Figure 32:
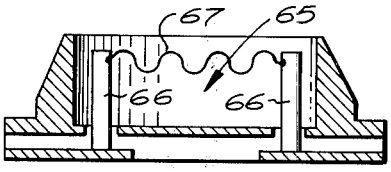
FIG. 32 is a sectional view of a thermally fusible grounding link.

A thermally fusible grounding element 65 is shown in FIG. 32. This element again has the same body member with a pair of posts 66 connected by a length of fusible wire 67. This element is essential to the safety circuitry and may be combined with a pyrotechnic delay mixture.

Figure 33:
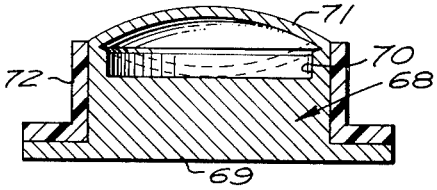
FIG. 33 is a sectional view of a through-wall conductor to projectile fusing contact.

A through wall conductor element 68 is shown in FIG. 33. This element is used to fuse ammunition such as the grenade shown in FIG. 21. A conductive body member 69 is provided with an annular cavity 70 centrally disposed therein. A belleville spring washer 71 is disposed in the cavity. An annular insulation member 72 is disposed around the body member so that the conductive body is insulated from the metal case of the grenade. The through wall conductors are mounted in recesses in the grenade fin 73 in a manner to allow the spring washer 71 to extend outward to contact the wall of the cartridge. When the round is fused, the firing takes place and the pressure buildup around the washer causes it to invert and thus cut off the contact with the cartridge.

The grenade 74 is made up of a body member 75 containing the explosive charge sealing means 76 positioned on the forward and after ends thereof and a conical after body 77 which supports radially outwardly directed fins 73. The fins have through bores 78 formed therein to allow ignition of powder bags 79. Small bore riding boresafe pins 80 are disposed in the outer edges of the fins.

The buckshot rounds shown in FIGS. 17 and 18 consist of a serrated plastic outer casing 81 which contains the powder and shot mixture. A plurality of metal structural elements 83 provide support against breech pressure. A metal sabot 84 serves as a portion of the outer casing and to receive the after end of the structural elements 83. A perforated metal shot retainer plate 85 receives the forward end of the structural elements. Annular sealing means 86 for sealing back pressure are disposed on the outer perimeter of the sabot 84. A positive opening snap ring is disposed inside the forward end of the plastic shot and powder retainer 81 to assure the proper splitting and opening of the casing releasing the shot.

The fletchette rounds, shown in FIGS. 19 and 20, consist of a partially serrated plastic outside casing 87. The internal wall is supported by an annular metal plate 88 and the outside after wall is supported by a second such plate 89. An internally directed annular area 90 is formed as a part of the casing 87 and serves to grip the fletchettes while the powder is fired driving the round ahead out. A frangible plastic powder retainer cap 91 closes the forward end of the casing.

A slug type round is shown in FIG. 35. This round consists of a conical disc-like sabot 92 with the central portion of the disc indented forming an annular protrusion 93 within the cone 92. A slug 94 resembling a 45-caliber slug is removably mounted to the protrusion 93. A fusible honeycomb material 95 formed to fit the forward and after contours of the sabot and slug combination is adapted to surround the slug and provide means for storing the propellant charge and also adds to the structural strength of the round.

The slug is blown free of the sabot as it leaves the barrel by a combination tracer-igniter-separation charge mix stored in the cavity 96 formed in the nose of the slug. A tracer mix is placed in the axially disposed annular bore 97 in the after end of the slug adjacent the charge in a manner so as to be ignited upon separation of the sabot.

Figure 34A:
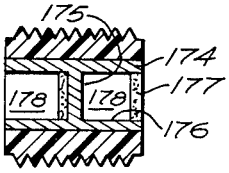
FIG. 34*a* is an individual delay increment unit of FIG. 34.
Figure 34:
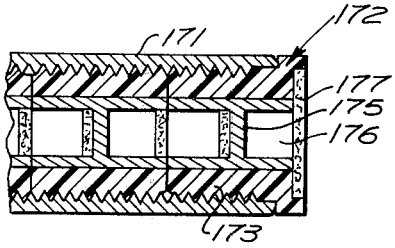
FIG. 34 is a sectional view of a hermetically sealed thermal conduction ignition delay train.

FIGS. 34 and 34*a* illustrate a thermal delay arrangement utilized in various types of ammunition for this system.

An internally screw-threaded tubular member 171 provides means for assembling a thermal delay train of selected time increments. An ignition unit 172 is placed in one end of the tubular member 171.

The igniter unit consists of an outer, externally screw-threaded sleeve 173 constructed of an insulating material. Centrally located in the sleeve 173 is a metal sleeve 174 having a transverse wall 175 formed centrally therein to provide annular recesses 176. These recesses contain a small amount of igniter mix 177 followed by a gasless heater mix 178 to provide a specific thermal delay increment.

FIG. 34*a* is a sectional view of a unit to be placed in the tubular member 171.

DESCRIPTION OF THE ELECTRICAL FEATURES

Figure 23:
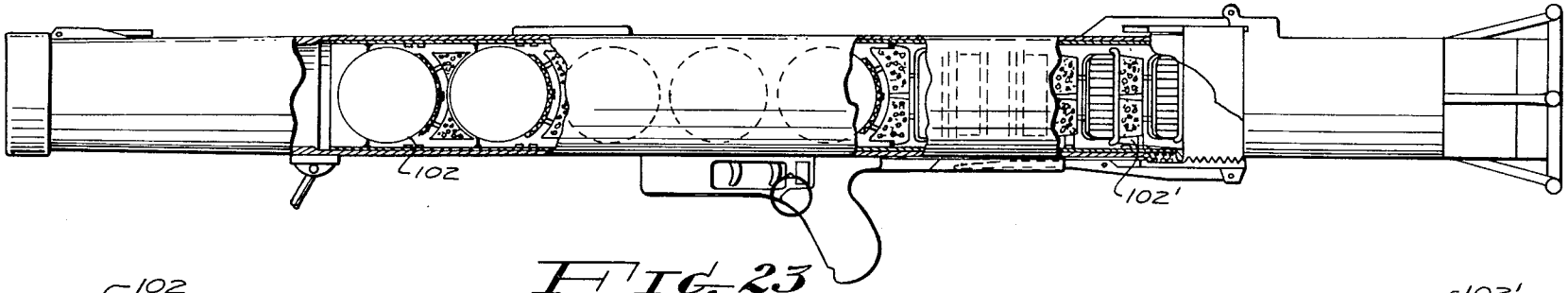
FIG. 23 is a fragmented elevational view of a recoilless rifle using the multiple round cartridge idea to automatically fire simultaneous masses of charge from both ends of the weapon to achieve recoilless operation.

The gun, when used as a recoilless rifle will have a single barrel containing a superimposed charge cartridge (FIG. 23) which contains the electrical circuits, the electric squibs 99 (FIG. 24), the thermally fusible grounding link 100 and the pressure switches 101 together with electrical conductors thereto directed longitudinally along the superimposed charge cartridge. The combinations of devices 99, 100, and 101 (FIG. 24) are cascaded along the superimposed charge cartridge and are associated with each superimposed charge 102. In an application where the superimposed charge cartridge contains recoilless operation charges, devices 99, 100 and 101 and the electrical conductors thereto are included in the superimposed charge cartridge in association with each recoil nullifying charge. The operation and interaction of the devices 99, 100 and 101 are such that when the first superimposed charge 102 at the end of the superimposed charge cartridge, is fired by sending an electric current through the electric squib 99 and simultaneously through the recoil squib 99′, the pressure switches 101 and 101′ are set to conduct by the pressure force of the exploding charges 102 and recoil charge 102′ respectively. The continuity through the pressure switches 101 and 101′ complete an electrical path through the succeeding charge electrical squib 103 and 103′ to enable the succeeding charge to be fired upon reception of an electrical pulse through superimposed charge cartridge contact ring 104, the conductors, and to the ground connection to the gun barrel. To insure that recoilless operation of the gun is optimized cascaded redundant circuits consisting individually of a thermopile 105 associated with a charge 102 fires a squib 105′ to detonate the recoil charge 102′ simultaneously with the detonation of charge 102. Similarly, a thermopile 106′ fires an electric squib 106 associated with the charge 102 to further insure the coincidence of recoilless firing. Other charges and their recoil inhibiting charge are arranged symmetrically in the cartridge and are fired symmetrically as described above.

The function of the thermally fusible grounding link 100 is to provide a conducting path around electric squib 103 in the event that pressure switch 101 becomes shorted accidentally, and this link also acts as a firing rate limiter. For example, squib 103 is bypassed from firing until thermally fusible element 100 has burned out. The burn out time is controlled by the pyrotechnic mixture encapsulating the fusible element 100.

Figures 10, 11, 12, 13, 14, 15:
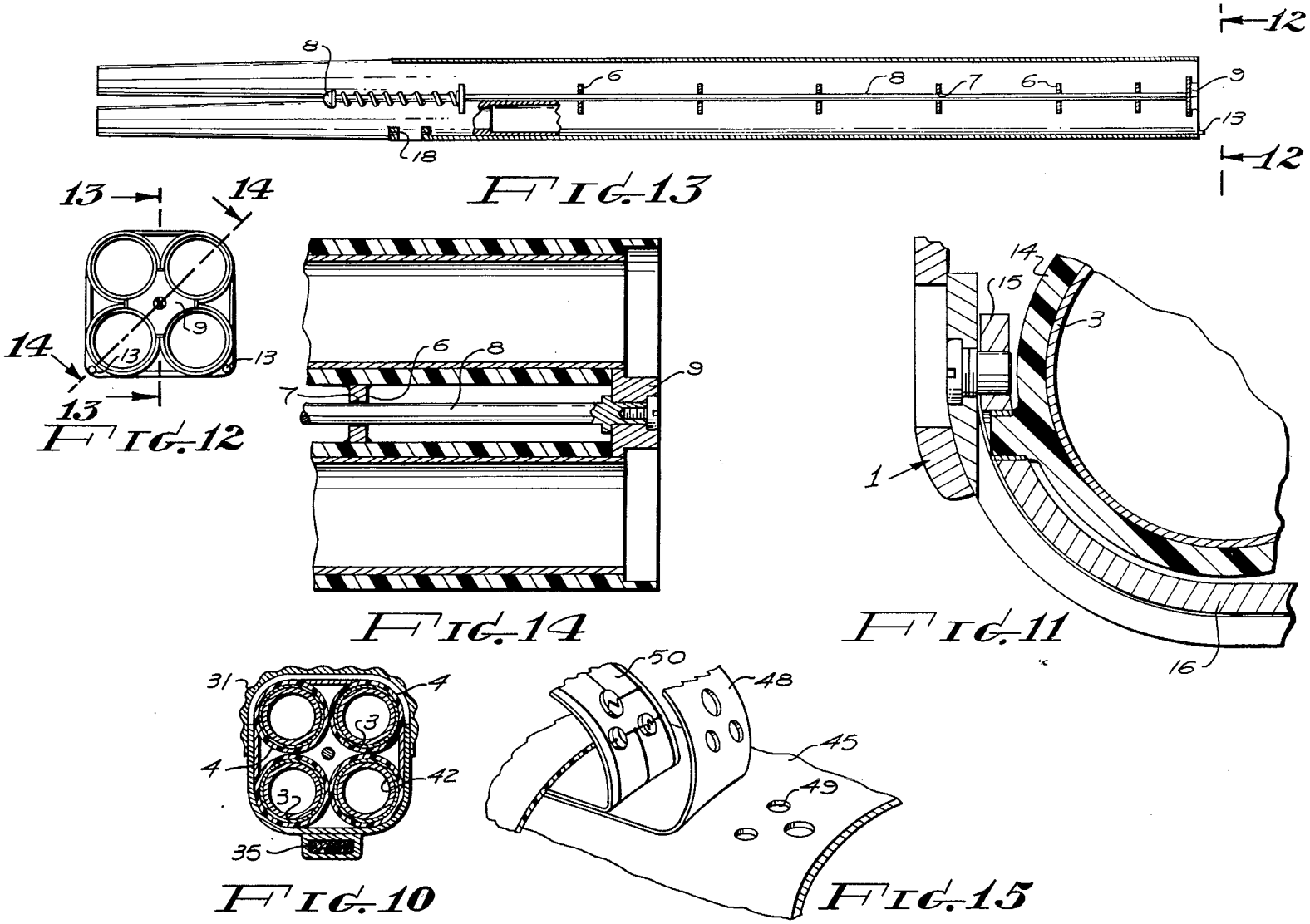
FIG. 10 is a sectional view 10—10 of FIG. 1 showing how the barrels are placed and held together as well as a sectional view of the passage holding the wiring leading from the trigger module to the breech mechanism.
FIG. 11 is an expanded view of FIG. 9 showing details of how the barrel assembly and the break mechanism function.
FIG. 12 is an end view of the breech end of the barrels showing the breech end of the extractor and the ends of the breech locking pins.
FIG. 13 is a longitudinal sectional of the barrel cluster showing details of the ejector rod placement and the lever latching block.
FIG. 14 is a sectional view 14—14 of FIG. 12 showing the ejector plate, ejector rod and the barrel arrangement.
FIG. 15 is a view showing the relationship of the shell, insulation, and the firing circuit.
Figure 25:
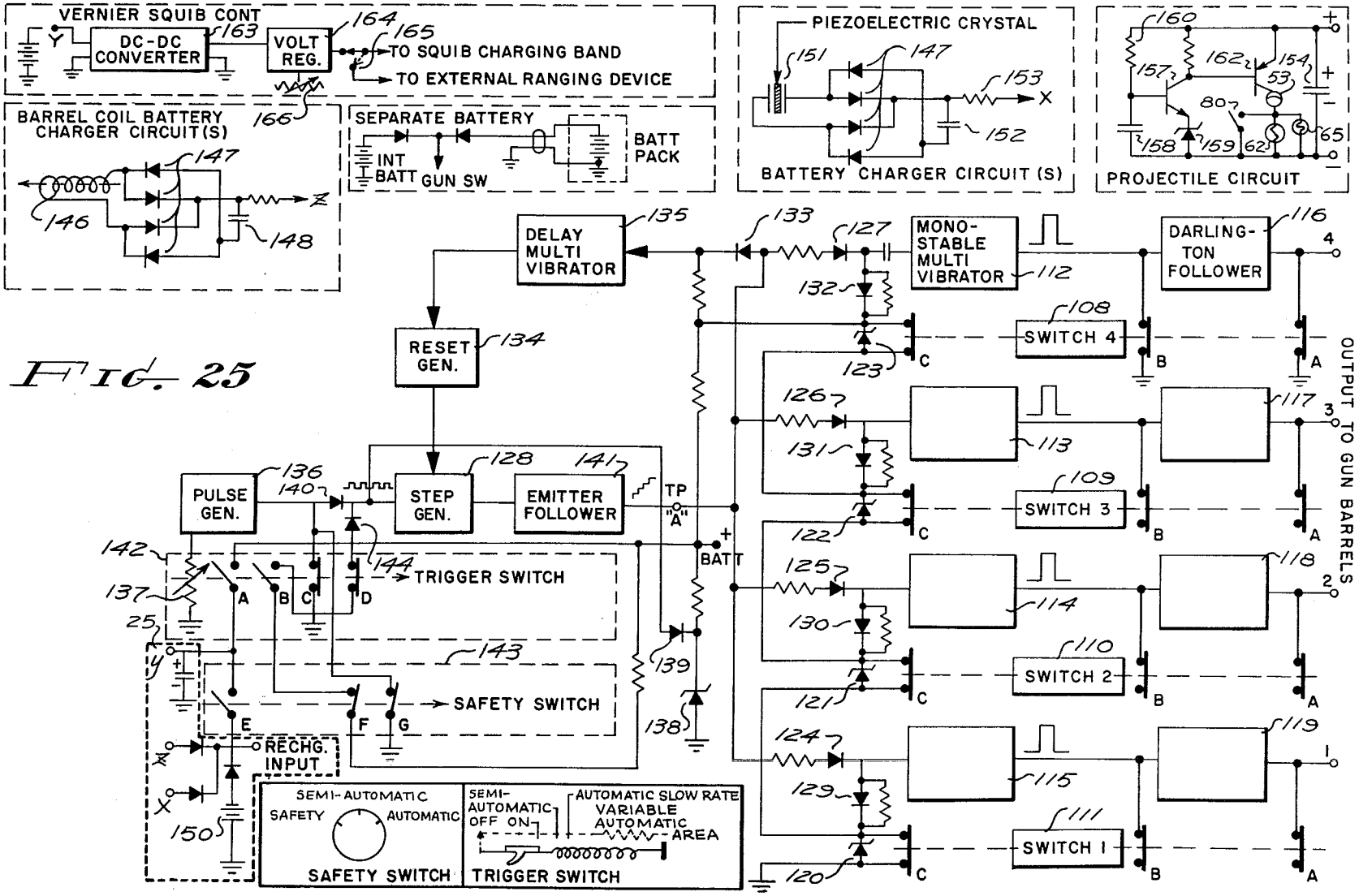
FIG. 25 is a circuit diagram showing the firing circuit, power generators and fusing circuits.
Figure 26:
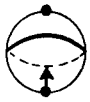
FIG. 26 is a symbol of FIG. 27.
Figure 29:
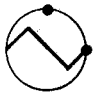
FIG. 29 is a symbol of FIG. 30.

Referring now to FIG. 14 in relation to FIG. 25, the firing pulse that enters the superimposed cartridge 42, FIG. 16, is generated in a special generator and control circuit, FIG. 25. The barrel selector switches 108 through 111, FIG. 25 (represented in FIG. 1 by numeral 23) are latching push in-push return type and can be used to select any combination of four barrels as described hereinbefore. Section A of the barrel selector switches 108 through 111 lifts ground from the particular barrel or barrels selected and Section B allows a pulse of integrated circuit (IC) multivibrators 112 through 115 to pass through to the power amplifiers (Darlington followers) 116 through 119. Section C removes the short from the particular zener diodes 120 through 123 which reverse bias the signal diodes 124 through 127. This biasing is designed to be progressively higher for each higher diode associated with each higher numbered barrel (1–4) and causes the barrels selected by the barrel switches 108 through 111 to be fired sequentially as step generator 128 passes an increasing voltage level to the multivibrators 112 through 115. Diodes 129 through 132 limit the pulse amplitude to each multivibrator at somewhat less than one step of step generator 128 and prevent higher steps from retriggering lower multivibrators. Diode 133 is reverse biased by the number of zener diodes selected by the barrel switches so as to become forward biased on the step number corresponding to the number of barrel switches depressed. This triggers the reset generator 134 through the delay multivibrator 135 which resets the step generator 128 to zero with a short pulse after the pulse generator 136 has completed the number of desired pulses. Thus the number of steps from the step generator is the same as the number of barrels in use.

The pulse generator 136 is a multivibrator IC which is frequency-controlled by the trigger potentiometer 137 and its pulse amplitude is set by zener diode 138 and standard diodes 139 and 140. The pulse amplitude at test point TP A is equal to the voltage across diodes 120 through 123. Bias on the emitter follower 141 is set to give a d.c. (average) potential at test point A equal to one-half the peak pulse (zener) voltage across diodes 120 through 123. This is a calibration adjustment.

The safety switch 143 is a rotary manually set switch having three positions. Position 1 is off with contacts E thereof being open. Position 2 closes contacts E and applies power to the circuits through the trigger switch 142 contact A. Position 3 offers the single shot circuit through contacts F and removes the short (contact G) on the output of the pulse generator 136 for multiple shots.

The trigger potentiometer 137 is mechanically coupled to the trigger and is actuated in any position beyond the single shot position of the trigger switch 142. Increased pulling results in increased pulse rate and more rapid firing. Single-shot pulses are generated by operating the trigger switch 142 such that contact A is closed, completing the circuit through contact F of the safety switch 143 enabling positive pulse amplitude to be set by diodes 138 and 139 for application to the step generator 128, emitter follower 141 and the monostable multivibrators 112 through 115. This enables the steps at test point A to be equal in amplitude to the zener voltage of the individual diodes 120 through 123. DC bias on the emitter follower is set to give a d.c. voltage at test point A equal to one-half the zener voltage of diodes 120 through 123.

The trigger switch 142 is a sequential contact switch having three fixed triggering modes and one variable mode in its travel from off to full on. Contact A of switch 142 turns off the battery power supplied through the safety switch. This is the rest position of the trigger. Pulling the trigger slightly energizes the circuits. Pulling further (mode 1) puts a d.c. pulse into the step generator 128 through contacts B and D and diode 144. Pulling yet further (mode 2) opens contact D first disabling the single shot circuit, then opening contact C to allow continuous pulses from the pulse generator 136 to be applied to the step generator 128. Yet further pulling of the trigger (mode 3) changes the resistance of potentiometer 137 to control the pulse rate and consequently, the rate of barrel firing.

RECHARGING CIRCUIT

The use of batteries for the firing circuits requires that provision be made for recharging. This is done by four different means; the first being a voltage generated in the barrel coil 5 of FIG. 7 when a charge is fired through the air core volume, the voltage being rectified by bridge diodes 147 and stored in d.c. form across capacitor 148 for application to point Z of the battery 150 recharge circuit; the second being piezoelectric elements 151 in parallel mounted in the breech block for recoil absorption that generates a voltage which is rectified by a second set of bridge diodes 147 for application to capacitor 152 and point X of the recharge circuit through limit resistor 153; the third means being an external battery charger connected to the battery charging circuit terminal mounted in the grip 25 of the gun; the fourth means being a magnetic slug operably attached to the trigger-like actuator 30 mounted on the front of the grip 25 and inserted into a coil such that a pulse is generated when the trigger is released rapidly against the urging of its bias spring. The pulse is applied to point X of the battery recharge circuit.

Figure 24:
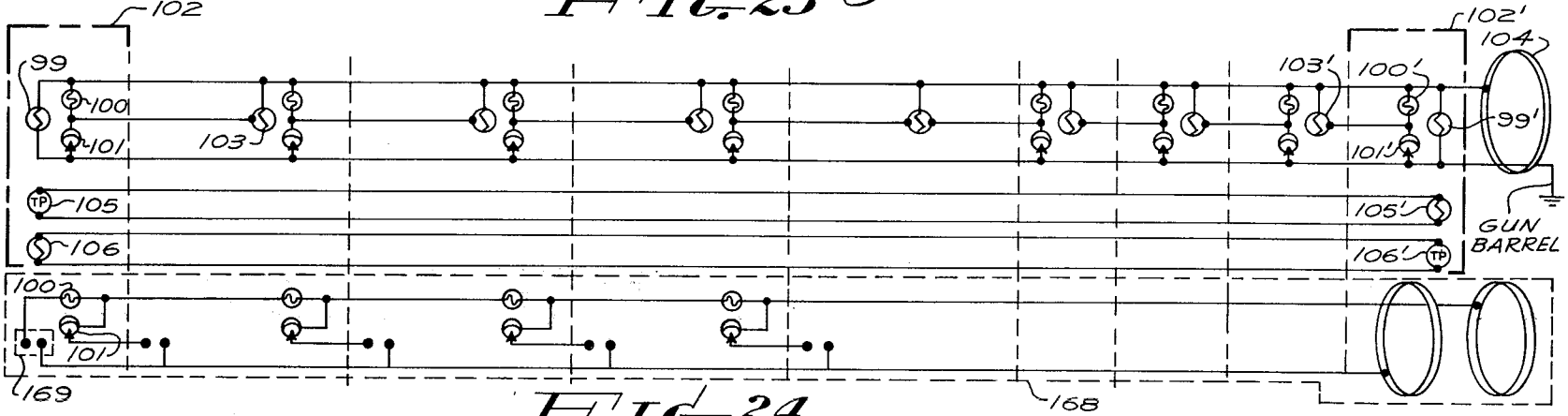
FIG. 24 shows a typical firing circuit to be used with a recoilless rifle showing annular band type contacts for placement around the cartridge casings.

A circuit is included in the electronics compartments of the pistol grip for firing the grenade type cartridge. This circuit includes a facility for imparting a linear-with-range timing voltage whereby the timed squib circuit in each grenade is set for the proper range-before-explosion. The linear-with-range timing voltage whereby the timed squib circuit in each grenade is set for the proper range-before-explosion. The linear-with-range voltage may be set by means of an external range finding apparatus such as a laser, acoustic, or infrared ranging system. Thus, a grenade fired from any of the four barrels would have the proper time lapse from firing to explosion in accordance with the desired range which is set by a voltage level imparted to each grenade through the vernier squib control circuit. The wiring circuit to each grenade in the cartridge is established along the cartridge shell and is shown in FIG. 24. The time delayed squib (projectile) circuit, FIG. 25, is integral with each grenade.

As shown in FIG. 25, an integrated circuit comprising; a capacitor 154, which takes a charge to the level set by the ranging circuit; a squib 155 which is shorted by a boresafe switch 156 until after the grenade projectile leaves the barrel; a standardizing circuit consisting of transistor 157 and zener diode 159 in conjunction with the biasing circuit consisting of capacitor 158 with resistor 160, is included in each projectile (grenade). The action of the circuit is such that both transistors 157 and 162 are cut off until capacitor 158 discharges to the point of transistor 157 conduction because of the leakage of the charge on capacitor 158 to the zener voltage of zener diode 159. When conduction through transistor 157 occurs, transistor 162 conducts thereby applying a current through the squib 155 when set. It should be noted that a charge that varies in accordance with the desired range of the projectile is imparted to capacitor 154 when the projectile is in the barrel. The time to explosion after firing depends only upon the level of the charge on the capacitor 154 and the time constant of the circuit consisting of resistor 160 and capacitor 158. Switch 80 (FIG. 21) is closed as soon as the projectile leaves the barrel exposing the squib 53 to the transistor 162 collector current. It is evident that the higher the charge on capacitor 154 the longer the time lapse between the firing and the exploding of the projectile.

The vernier squib control circuit includes: a DC to DC converter 163 to raise the battery voltage to a higher voltage whereby the range of voltage settings on the capacitor 154 is expanded; a voltage regulator 164; a selector switch 165 for the external range measuring apparatus or the included manual trigger 22 operated potentiometer 166. The output of the circuit is applied to the projectile through the wiring circuit 168 (FIG. 24) on the cartridge containing the projectile. This circuit includes the capacitor charging band, the pressure switches 101, the fusible grounding links 100 and the contacts 169 to the projectile contact 68. The functions of the devices 100 and 101 are the same as in the superimposed charge 102 circuit.

For safety, the thermally fusible grounding link 65 provides a conducting path around the squib 62 in the event of failure of the boresafe switch 156. Additionally, the pressure switch 53 is provided in series with the squib 62 so that the squib circuit is not connected unless the normal pressure impulse from a prior grenade or initial charge firing is received.

The above described embodiments of this invention are merely descriptive of its principles and are not to be considered limiting. The scope of this invention instead shall be determined from the scope of the following claims, including their equivalents.

What is claimed is:

1. A cartridge for an electrically fired weapon system comprising;

an elongated casing including an end opening;

a plurality of individual superimposed charges in said casing, each positioned to be propelled in sequence through said end opening; each of said superimposed charges comprising projectile means and a propellant charge;

detonator means for each of said charges and positioned to detonate and propel each projectile means in sequence through said end opening;

electrical contact means extending longitudinally along said casing in energizing relationship with respective detonator means;

including fusible link means short circuiting at least one of said squib means;

said fusible link means positioned to be fired by detonation of the charge preceeding the charge associated with said squib means of the next succeeding charge; and further including pressure responsive switch means positioned within the wall of said casing in detonation pressure communication with at least one of said charges.

2. The combination in accordance with claim 1 wherein said pressure responsive switch means is in the firing circuit of said cartridge.

3. The combination in accordance with claim 2 wherein said pressure responsive means comprises a plurality of pressure operated switches associated with each of said charges and each of said switches in pressure actuation relationship with one charge and in electrical series with the firing circuit of the next succeeding charge.

4. The combination in accordance with claim 2 wherein said pressure switches are normally open and closed by the pressure impulse on detonation of its pressure associated charge.

5. A cartridge for an electrically fired weapon system comprising;

an elongated casing including an end opening;

a plurality of individual superimposed charges in said casing, each positioned to be propelled in sequence through said end opening; each of said superimposed charges comprising projectile means and a propellant charge;

detonator means for each of said charges and positioned to detonate and propel each projectile means in sequence through said end opening;

electrical contact means extending longitudinally along said casing in energizing relationship with respective detonator means;

including fusible link means short circuiting at least one of said squib means;

said fusible link means positioned to be fired by detonation of the charge preceeding the charge associated with said squib means of the next succeeding charge.

6. A cartridge for an electrically fired weapon system comprising;

an elongated casing including an end opening;

a plurality of individual charges in said casing, each comprising projectile means, a propellant charge and detonator means, all positioned for sequential detonation and propelling of respective projectile means through said end opening;

said casing having a plurality of through bores therein communicating with each respective charge;

electrical conductor means extending longitudinally along said casing; and said detonator means comprising an electrically fired squib means communicating through said through bore with said electrical conductor means in detonation relationship with said propellant charge and into detonation relationship with the charge; and including individual pressure responsive switch means positioned and associated with individual of said plurality of charges; and including fusible link means positioned in at least one of said through bores wherein said fusible link means is connected to said electrical conductor means in short circuit relationship with the squib means of the next succeeding charge.

7. The combination in accordance with claim 6 wherein said fusible link means is detonation fusible and connected to normally grounded said squib means to said casing.

8. The combination in accordance with claim 6 wherein said cartridge includes a plurality of charges arranged in superimposed relationship in said casing, each of said charges including an individual squib means;

fusible shorting link electrically connected across each of said squib means; and normally open pressure sensitive switch means in series with the firing circuit of each of said charges to enable said charges in sequence to be fired.

* * * * *